US005998934A

United States Patent [19]

Mimasu et al.

[11] Patent Number: 5,998,934

[45] Date of Patent: Dec. 7, 1999

[54] MICROWAVE-EXCITED DISCHARGE LAMP APPARATUS

[75] Inventors: Mutsumi Mimasu, Hikone; Koichi Katase, Osaka; Katsushi Seki, Moriyama, all of Japan

[73] Assignee: Matsushita Electronics Corporation, Osaka, Japan

[21] Appl. No.: 09/072,587

[22] Filed: May 4, 1998

[30] Foreign Application Priority Data

May 15, 1997 [JP] Japan ..... 9-125788

[51] Int. Cl.[6] ..... H01J 7/24

[52] U.S. Cl. ..... 315/118; 315/248; 315/39.51; 315/344; 362/373; 362/351; 313/35

[58] Field of Search ..... 315/118, 112, 315/248, 39, 39.51, 267, 344; 362/373, 351, 345; 313/35, 148, 149

[56] References Cited

U.S. PATENT DOCUMENTS

| | | | |
|---|---|---|---|
| 3,872,349 | 3/1975 | Spero et al. | 315/39 |
| 4,485,332 | 11/1984 | Ury et al. | 315/112 |
| 4,498,029 | 2/1985 | Yoshizawa et al. | 315/39 |
| 4,501,993 | 2/1985 | Mueller et al. | 315/248 |
| 4,507,587 | 3/1985 | Wood et al. | 315/39 |
| 5,039,918 | 8/1991 | Ohtake et al. | 315/248 |

FOREIGN PATENT DOCUMENTS

| | | |
|---|---|---|
| 57-63705 | 4/1982 | Japan . |
| 61-116750 | 6/1986 | Japan . |
| 61-216299 | 9/1986 | Japan . |

*Primary Examiner*—Haissa Philogene
*Attorney, Agent, or Firm*—Akin, Gump, Strauss, Hauer & Feld, L.L.P.

[57] ABSTRACT

A microwave-excited discharge lamp apparatus of the present invention has a translucent blow guide 6 arranged around a microwave-excited discharge lamp 4. Thereby, even when the microwave-excited discharge lamp 4 is reduced in size, the microwave-excited discharge lamp 4 can be cooled efficiently without complicating or increasing the size of the apparatus.

4 Claims, 9 Drawing Sheets

MICROWAVE-EXCITED DISCHARGE LAMP APPARATUS

BACKGROUND OF THE INVENTION

The present invention relates to a microwave-excited discharge lamp apparatus which emits light by discharge under a microwave electromagnetic field.

In recent years, in accordance with demands of energy saving etc., high intensity discharge lamps have been attracting attention. The reason why is that the high intensity discharge lamps can easily provide large light output compared with fluorescent lamps which give light output through phosphors. The high intensity discharge lamps are divided into two types: an electrode type discharge lamp having electrodes, such as a metal halide lamp and a mercury lamp; and an electrodeless type discharge lamp such as a microwave-excited lamp.

In the microwave-excited lamp, a predetermined microwave electromagnetic field is formed by a magnetron or the like microwave generator, and plasma discharge caused by a microwave electromagnetic field is used as a light source. The microwave-excited lamp has a long life compared with the electrode type discharge lamp limited by deterioration of the electrodes. Furthermore, in the microwave-excited lamp, an emission spectrum of the light output does not almost deteriorate after a long period of service because of electrodeless configuration.

Moreover, since change of impedance between operating condition and extinguished condition is small, the microwave-excited discharge lamp provides far greater advantages than the electrode type discharge lamp with regard to characteristics of flashing operation, starting, and restarting. The microwave-excited discharge lamp also has a remarkable advantage over the electrode type discharge lamp in view of environmental protection. The reason why is that, as has been described in the above, the microwave-excited discharge lamp has the long life, and thereby components of the microwave-excited discharge lamp need not be exchanged for a long time. Furthermore, the microwave-excited discharge lamp gives light output having the brightness and efficacy comparable to those of the electrode type discharge lamp without use of environment-harmful mercury.

A conventional microwave-excited discharge lamp apparatus disclosed in unexamined and published Japanese patent application TOKKAI Hei 3-49102 will be described with reference to FIG. 11 specifically.

As shown in FIG. 11, the conventional microwave-excited discharge lamp apparatus comprises a microwave generator 51 for generating a microwave, a waveguide 52 for propagating the microwave generated in the microwave generator 51, a cavity 53 connected to the waveguide 52, and a microwave-excited discharge lamp (hereinafter referred to as "a lamp") 54 arranged in the cavity 53.

The microwave generator 51 includes a magnetron 51*a* for generating a microwave of, for example, 2450 MHz with an output of several kW, an antenna 51*b* for radiating the microwave generated, and a fan 51*c* for cooling the magnetron 51*a*. A high voltage power supply 55 for driving is connected to the magnetron 51*a*.

The waveguide 52 is configured of a metal box member having a rectangular section, for example. The antenna 51*b* is housed at one end of the waveguide 52, and a power feeding window 52*a* and an aperture 52*b* in the opposite relation to the power feeding window 52*a* are formed in the other end of the waveguide 52.

The cavity 53 is formed of a metal material such as copper and includes a substantially cylindrical member 53*a* with open ends and a mesh plate 53*b* arranged on one of the open ends of the cylindrical member 53*a*. The other open end of the cylindrical member 53*a* is mounted on the surface of the waveguide 52 in such a manner as to surround the power feeding window 52*a* of the waveguide 52.

The internal space of the cavity 53 forms a cavity resonator for accumulating microwave energy. In the case that the microwave is radiated from the power feeding window 52*a*, a predetermined microwave electromagnetic field is formed in the internal space of the cavity 53. Also, the light generated in the lamp 54 by the plasma discharge is emitted outside as a light output through the mesh plate 53*b*. A reflector (not shown) for reflecting visible light is arranged on the inner wall of the cavity 53 in order to retrieve the light output efficiently in a single direction.

The lamp 54 is formed of translucent quartz glass or the like in a substantially spherical or elongate cylindrical form, and is arranged in the internal space of the cavity 53 by a supporting rod 56 of quartz glass. The lamp 54 hermetically contains therein a rare gas such as argon, a small amount of mercury and a metal halide such as thallium iodide providing a luminous material. The internal pressure of the lamp 54 in an extinguished condition is regulated at about 100 to 200 Torr in order to easily perform a starting operation, i.e. a starting of the below-mentioned plasma discharge of the rare gas. The supporting rod 56 is connected to a motor 57 for rotating the lamp 54 through the power feeding window 52*a* and the aperture 52*b* of the waveguide 52 and further through a connecting jig 57*a*. The rotation of the motor 57 stabilizes the plasma discharge in the lamp 54 while at the same time cooling the lamp 54.

A pair of nozzles 58 are arranged in the vicinity of the lamp 54 for injecting a cool air flow supplied from a compressor not shown. As a result, the lamp 54 is sufficiently cooled, thereby to prevent thermal degeneration of the lamp 54 caused by the plasma discharge. It is known that the pair of the nozzles 58 are provided corresponding to the size of the lamp 54 and the output of the magnetron 51*a*, and are included in the conventional microwave discharge apparatus. Specifically, in the case that the output of the magnetron 51*a* is not less than several kW and the spherical lamp 54 is not more than 8 mm in diameter, for example, the pair of the nozzles 58 is arranged in the vicinity of the lamp 54.

In the case that the output of the magnetron 51*a* is small and the lamp 54 is large in size, in contrast, the lamp 54 is sufficiently cooled by the rotation of the motor 57, so that the thermal degeneration of the lamp 54 by the plasma discharge is suppressed to some degree. In such a case, therefore, the nozzles 58 are not generally included in the conventional microwave-excited discharge lamp apparatus. Furthermore, another conventional microwave-excited discharge apparatus with a small output of the magnetron 51*a* and a large lamp 54 has been proposed, in which the cooling air (cooled air) from the fan 51*c*, after being used for cooling the magnetron 51*a*, is blown to the lamp 54 instead of using the motor 57. Specifically, the cooling air is supplied from the power feeding window 52*a* through the interior of the waveguide 52 and blown to the lamp 54. As another alternative, the cooling air is guided using a guide plate or the like and blown to the lamp 54 from outside the mesh plate 53*b*.

Operation of the conventional microwave-excited discharge lamp apparatus will be described.

Upon application of a high voltage to the microwave generator 51 from the high voltage power supply 55, the microwave is radiated from the antenna 51*a* of the microwave generator 51 into the waveguide 52. This microwave is propagated through the waveguide 52 and radiated to the cavity 53 from the power feeding window 52*a* formed in the waveguide 52. As a result, the predetermined microwave electromagnetic field is formed in the internal space of the cavity 53. The microwave electromagnetic field causes a dielectric breakdown of the rare gas and thus starts the plasma discharge. The plasma discharge increases the temperature of the inner wall of the lamp 54, whereby the mercury and the metal halide are vaporized, thereby increasing the internal pressure of the lamp 54. As long as the temperature at the coldest point of the inner wall and the internal pressure are stabilized at a predetermined value, respectively, i.e. in steady state operating condition, light having a predetermined emission spectrum is generated in the lamp 54 by the plasma discharge of the metal vapor. This light is radiated out through the mesh plate 53*b* from the cavity 53 as the light output. In the above-mentioned steady state operating condition, the pressure of the metal vapor represents a larger proportion of the internal pressure of the lamp 54 than that of the rare gas.

The above-mentioned conventional microwave-excited discharge lamp apparatus is required to comprise component members such as the pair of the nozzles and the air compressor used exclusively for cooling the lamp in accordance with the size of the lamp and the output of the magnetron. As a result, the configuration of the microwave-excited discharge lamp apparatus is complicated and becomes bulky. These problems present themselves conspicuously especially when the lamp is reduced in size for reducing the size of the light source. The reason is that in the case that the lamp is reduced in size, the plasma discharge occurs in the vicinity of the inner wall of the lamp, resulting in an increased tube wall temperature of the lamp. Thereby, the thermal degeneration of the lamp is accelerated, so that the lamp breaks or devitrifies, often shortening the life of the lamp. Further, with the increase in the temperature of the inner wall, the steady state operating condition of the lamp becomes unstable, thereby deteriorating the lighting characteristic. As a result, with the conventional microwave-excited discharge lamp apparatus having a smaller lamp, it is always necessary to provide the above-mentioned component members dedicated to cooling the lamp, thereby complicating and making bulky the configuration of the apparatus.

Furthermore, in the case that the light output from the light source is used by means of converging the light through a lens or a reflecting mirror, reducing the size of the light source is strongly demanded in order to efficiently extract the light output. As described in "Small Long-Lived Stable Light Source for Projection-Display Applications," International Symposium Digest, Technical Report, Vol. 24, pp. 716–719, for example, when the lamp is used as a backlight source for a projection display, it is strongly required that the lamp attains to the small size in order to efficiently extract the light output from the backlight source.

However, in the conventional microwave-excited discharge lamp apparatus, when the lamp attains to the small size, there are problems that the configuration of the apparatus complicates and makes bulky as described above. As a result, it has been difficult to use the conventional microwave-excited discharge lamp apparatus as the backlight source of the projection display or the like.

Further, with the conventional configuration in which the cooling air, after cooling the magnetron, is blown to the lamp from a power feeding window, the internal space of the cavity is suddenly expanded from the power feeding window. Therefore, the cooling air is excessively diffused when blowing into the internal space of the cavity from the power feeding window. Thereby, it was impossible to cool the lamp efficiently. Also, even with the conventional configuration in which the cooling air is blown from a mesh plate side, the mesh plate blocks the flow of the cooling air, and therefore the lamp cannot be cooled efficiently.

BRIEF SUMMARY OF THE INVENTION

The object of the present invention is to provide a microwave-excited discharge lamp apparatus that can solve the aforementioned problems in the conventional apparatus and can be configured with less cost and has a long life.

In order to achieve the above-mentioned object, a microwave-excited discharge lamp apparatus comprises:

- a microwave generator,
- a waveguide for propagating a microwave from the microwave generator,
- a cavity resonator unit connected to the waveguide and for forming a predetermined microwave electromagnetic field,
- a lamp arranged in the cavity resonator unit and sealing a luminous material,
- a rotary supporter for supporting the lamp rotatably,
- a translucent blow guide arranged around the lamp and for conducting a gas to the lamp for cooling the lamp.

With this configuration, the lamp can be efficiently cooled without complicating or increasing the size of the configuration of the microwave-excited discharge lamp apparatus.

In the microwave-excited discharge lamp apparatus of another aspect of the present invention, the blow guide is made of translucent quartz glass or a translucent ceramic material.

With this configuration, the light output from the lamp can be radiated outside without being interrupted.

In the microwave-excited discharge lamp apparatus of another aspect of the present invention, the cavity resonator unit is made of a metal mesh material or a transparent conductive film arranged on the outer surface of the blow guide.

With this configuration, the mechanical strength of the cavity resonator unit can be improved.

In the microwave-excited discharge lamp apparatus of another aspect of the present invention, the lamp is rotatably supported in such a manner as to rotate by an air flowing in the blow guide.

With this configuration, the configuration of the microwave-excited discharge lamp apparatus can be simplified.

DESCRIPTION OF THE PREFERRED EMBODIMENTS

Hereafter, preferred embodiments of a microwave-excited discharge lamp apparatus of the present invention is described below with reference to the accompanying drawing.

<<First Embodiment>>

Figure 1:
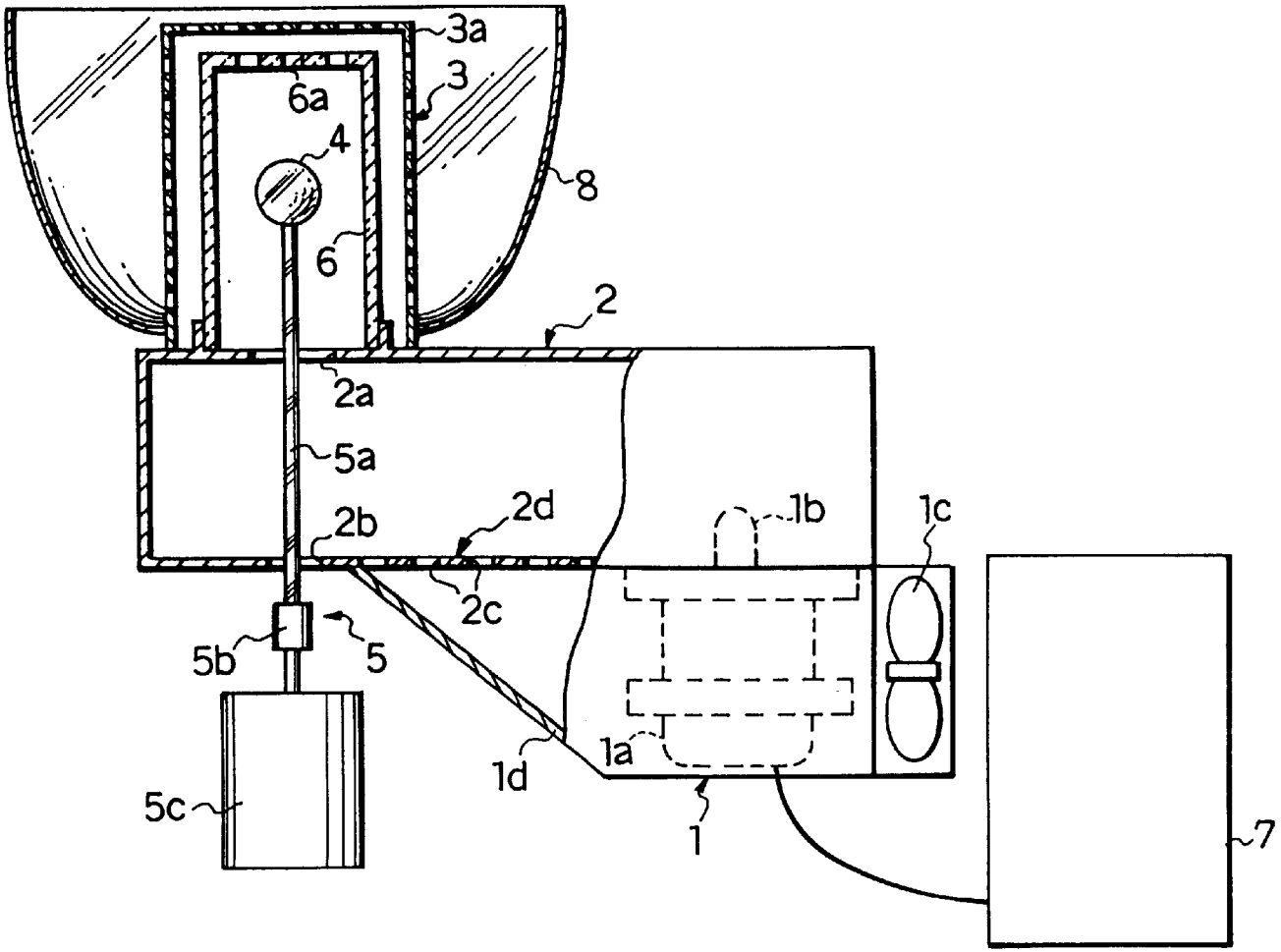
FIG. 1 is a schematic plan view showing a configuration of a microwave-excited discharge lamp apparatus in a first embodiment of the present invention.

As shown in FIG. 1, a microwave-excited discharge lamp apparatus of this embodiment comprises a microwave generator 1 for generating a microwave, a waveguide 2 for propagating the microwave to a cavity resonator unit 3, and a microwave discharge lamp (hereinafter referred to as "a lamp") 4 arranged in the cavity resonator unit 3. Further, the microwave-excited discharge lamp apparatus comprises a rotary supporter 5 for supporting the lamp 4 rotatably, and a blow guide 6 arranged around the lamp 4 in the cavity resonator unit 3 for conducting a cooling air (cooled air) to the lamp 4 for cooling the lamp 4.

The microwave generator 1 includes a magnetron 1*a* for generating a microwave of 2450 MHz, for example, with an output of several kW, an antenna 1*b* for radiating the microwave thus generated, and a fan 1*c* for cooling the magnetron 1*a*. The magnetron 1*a* is connected with a high voltage power supply 7 for driving the same. Further, the magnetron 1*a* is arranged in a duct 1*d*. This duct 1*d* functions as an air passage for conducting the cooling air generated by the fan 1*c* into the waveguide 2 after cooling the magnetron 1*a*.

The waveguide 2 is configured of a box-shaped body of a metal having a rectangular section, for example. The antenna 1*b* is contained at one end of the waveguide 2, and a power feeding window 2*a* and a hole 2*b* in the opposite relation with the power feeding window 2*a* are arranged at the other end of the waveguide 2. This waveguide 2 is formed in accordance with the EIA (Electronic Industries Association) specification, for example. Specifically, in order to conduct microwaves of 2170 MHz to 3300 MHz efficiently, the waveguide 2 has a length of 100 cm and a rectangular section of 86.36×43.18 mm, for example. Also, a stub (not shown) or the like functioning as a matching circuit is arranged in the waveguide 2 for efficiently conducting the microwave from the antenna 1*b* to the cavity resonator unit 3. Further, the waveguide 2 includes an aperture 2*d* having a plurality of holes 2*c* for securing communication between the duct 1*d* and the interior of the waveguide 2. As a result, the cooling air generated by the fan 1*c*, after cooling the magnetron 1*a*, is supplied into the blow guide 6 from the power feeding window 2*a* through the duct 1*d*, the aperture 2*d* and the waveguide 2, and blown onto the lamp 4 arranged in the blow guide 6. The power feeding window 2*a*, the hole 2*b* and the holes 2*c* are formed in circles of, say, 30 mm, 20 mm and 5 mm, respectively, in diameter.

The cavity resonator unit 3 is configured of a metal mesh material 3*a* of a metal such as copper so as to pass the radiation from the lamp 4 as a light output. This metal mesh member 3*a* has a cylindrical open end and is mounted on the surface of the waveguide 2 in such a position that the particular open end surrounds the power feeding window 2*a* of the waveguide 2. The internal space of the cavity resonator unit 3 constitutes a cavity resonator for accumulating the energy of the microwave. That is, in the case that the microwave is radiated from the power feeding window 2*a*, a predetermined microwave electromagnetic field is formed in the internal space of the cavity resonator unit 3. Further, when the below-mentioned impedance matching condition is satisfied, the cavity resonator unit 3 can generate a plasma discharge efficiently in the lamp 4 without leaking any microwave outwards the metal mesh member 3*a*. As a result, the light output can be radiated efficiently outwards the metal mesh member 3*a*. A substantially cylindrical reflector 8 is arranged on the outside of the cavity resonator unit 3 for radiating the light output from the lamp 4 efficiently in one direction.

The lamp 4 is formed of translucent quartz glass or a ceramic material such as alumina ceramic in a hollow spherical form having an outer diameter of 6 mm and an inner diameter of 3 mm, for example. The lamp 4 is arranged on the rotary supporter 5 in the predetermined microwave electromagnetic field. The internal space of the lamp 4 is sealed with a rare gas such as argon, krypton or xenon and a material contributing to illumination such as a metal halide having an emission spectrum in the visual range. A specific example of the material contributing to illumination is sodium iodide or the like material having an emission spectrum over the entire visual range by itself, or a combination of a plurality of metal halides such as gadolinium iodide, lutetium iodide and thallium iodide. Instead of the above-mentioned metal halides, sulphur that has an emission spectrum close to that of sunlight may be used as the material that contributes to the emission of light. The internal pressure of the lamp 4 in an extinguished condition is regulated at several kPa to several tens of kPa in order to easily perform a starting operation, i.e. a starting of the below-mentioned plasma discharge of the rare gas. The lamp 4 may be of any shape including an elongate cylinder and is not limited to a sphere.

The rotary supporter 5 includes a supporting rod 5*a* formed of quartz glass or the like, and a motor 5*c* connected to the supporting rod 5*a* through a connecting jib 5*b*. The supporting rod 5*a* supports the lamp 4 through the power feeding window 2*a* and the hole 2*b* of the waveguide 2 without adversely affecting the hermeticity of the lamp 4. The motor 5*c* rotates the lamp 4 at a predetermined rotation speed when the lamp 4 is in a lighting condition. As a result of this operation, the lamp 4 is cooled while at the same time stabilizing the plasma discharge in the lamp 4. Specifically, the rotation of the lamp 4 suppresses an unstable phenomenon due to the plasma discharge such as the contraction of the arc thereof and stabilizes the plasma discharge by securing a substantially uniform arc shape. As described in "Fundamentals of Plasma Engineering", by A. von. Engel, published by Ohm co., 1985, for example, the stabilization of the plasma discharge can secure a uniform tube wall temperature of the lamp 4.

The blow guide 6 is formed of translucent quartz glass, or a ceramic material such as alumina ceramic substantially in the shape of a cylinder with an end thereof open. The open end of the blow guide 6 is mounted on the surface of the waveguide 2 in such a position as to surround the power feeding window 2*a*. The end of the blow guide 6 opposed to the open end is formed with a plurality of holes 6*a* for relieving the cooling air after cooling the lamp 4. As a specific example, each hole 6*a* has a diameter of 10 mm, and by changing the number and size of the holes 6*a*, the amount of the cooling air and hence the cooling efficiency of the lamp 4 can be adjusted.

The provision of the blow guide 6 makes it possible to blow the cooling air to the lamp 4 into the cavity resonator unit 3 from the power feeding window 2*a* without cutting off or reducing the light output from the lamp 4 or without dispersion of the above-mentioned cooling air. As a result, the lamp 4 is efficiently cooled by the cooling air. Furthermore, the blow guide 6 is arranged in the cavity resonator unit 3 having an internal space of a predetermined size for forming the predetermined microwave electromagnetic field, and therefore the microwave-excited discharge lamp apparatus not bulky is provided.

Now, operation of the microwave-excited discharge lamp apparatus will be described.

When a high voltage is supplied from the high voltage power supply 7 to the magnetron 1*a*, the microwave generator 1 is activated, so that the microwave of 2450 MHz is radiated from the antenna 1*b* into the waveguide 2. This microwave is conducted through the interior of the waveguide 2 and radiated to the cavity resonator unit 3 from the power feeding window 2*a*, thereby form the predetermined microwave electromagnetic field in the internal space of the cavity resonator unit 3. The microwave electromagnetic field causes a dielectric breakdown of the rare gas and starts the plasma discharge in the lamp 4. As a result of this plasma discharge, the temperature of the inner wall of the lamp 4 rises. Accordingly, the mercury and the metal halide are vaporized thereby to increase the internal pressure of the lamp 4. The temperature of the coldest point of the inner wall and the internal pressure of the lamp 4 come to be settled at a predetermined value (500 to 600° C. and 101.3 kPa to 202.6 kPa, respectively, for example), i.e. the apparatus comes to be settled in a steady state operating condition. Under this condition, the plasma discharge of the metal vapor is generated in the lamp 4. The light having an emission spectrum defined by the sealed metal halide is radiated outwards the metal mesh member 3*a* of the cavity resonator unit 3 as the light output. Under the above-mentioned steady state operating condition, the pressure of the metal vapor represents a larger proportion of the internal pressure of the lamp 4 than that of the rare gas.

Furthermore, in the steady state operating condition, the impedance matching condition is satisfied between the waveguide 2 and the resonator including the cavity resonator unit 3 and the lamp 4. Specifically, the load of the resonator dependent on the loss due to the plasma discharge in the lamp 4 or the appropriate loss due to the eddy current generated in the inner wall of the cavity resonator unit 3 exceeds the value of the load of the resonator in the extinguished condition. Further, in steady state operating condition, the load of the resonator assumes a value substantially equal to the impedance of the waveguide 2.

For this reason, in steady state operating condition, the microwave is radiated toward the cavity resonator unit 3 without being substantially reflected on the power feeding window 2*a* of the waveguide 2, thus accomplishing an efficient plasma discharge within the lamp 4. As a result, in the microwave-excited discharge lamp apparatus of this invention, the light output can be radiated outwards the metal mesh member 3*a* with high efficiency.

Furthermore, in this steady state operating condition, the lamp 4 is being rotated by the motor 5*c* at the predetermined rotational speed. Therefore, the plasma discharge is stabilized and the inner wall temperature of the lamp 4 becomes uniform. In addition, the rotation of the lamp 4 by the motor 5*c* and the above-mentioned cooling air conducted by the blow guide 6 cool the lamp 4 efficiently. As a result, the temperature of the coldest point is maintained at a constant level, so that a stable lighting characteristic of the lamp in steady state operating condition can be obtained during the entire life of the lamp 4.

With the microwave-excited discharge lamp apparatus of this embodiment, the lamp 4 is rotated on the rotary supporter 5 and the cooling air blown into the cavity resonator unit 3 from the power feeding window 2*a* is conducted to the vicinity of the lamp 4 by the blow guide 6. Consequently, the lamp 4 is efficiently cooled to a sufficient extent by the rotation thereof caused by the motor 5*c* and together with the cooling air. Accordingly, the thermal degeneration of the lamp 4 which otherwise would be caused by the plasma discharge is suppressed, thereby preventing the life of the lamp 4 from being shortened. As a result, with the microwave-excited discharge lamp apparatus of this embodiment, even with a smaller lamp 4, it is possible to eliminate the exclusive lamp-cooling component parts such as the aforementioned pair of the nozzles and the air compressor. In this way, a complex configuration and a large size of the lamp 4 can be avoided. Furthermore, since the lamp 4 can be reduced in size without complicating the configuration or increasing the size of the lamp apparatus, the embodiment can provide a microwave-excited discharge lamp apparatus suitable for use as a backlight source of a VPS (Video Projection System) such as a liquid crystal projection display system.

In the microwave-excited discharge lamp apparatus described above, the magnetron 1*a* is arranged in the duct 1*d*, and the aperture 2*d* for communication between the duct 1*d* and the waveguide 2 is formed in the waveguide 2, so that the cooling air that has cooled the magnetron 1*a* is conducted into the blow guide 6 from the power feeding window 2*a* of the waveguide 2. However, the configuration for conducting the cooling air to the power feeding window 2*a* is not limited to the above-mentioned configuration. Alternatively, for example, the cooling air from the fan 1*c* can be conducted to the hole 2*b*, and can be blown intensively on the lamp 4 in the blow duct 4 from the power feeding window 2*a* along the supporting rod 5*a*. As another alternative, at least a blade is attached on the supporting rod 5*a*, so that an air can be generated by the blade upon the rotation of the motor 5*c*, and blown forcibly toward the blow guide 6 from the power feeding window 2*a* as the cooling air.

<<Second Embodiment>>

Figure 2:
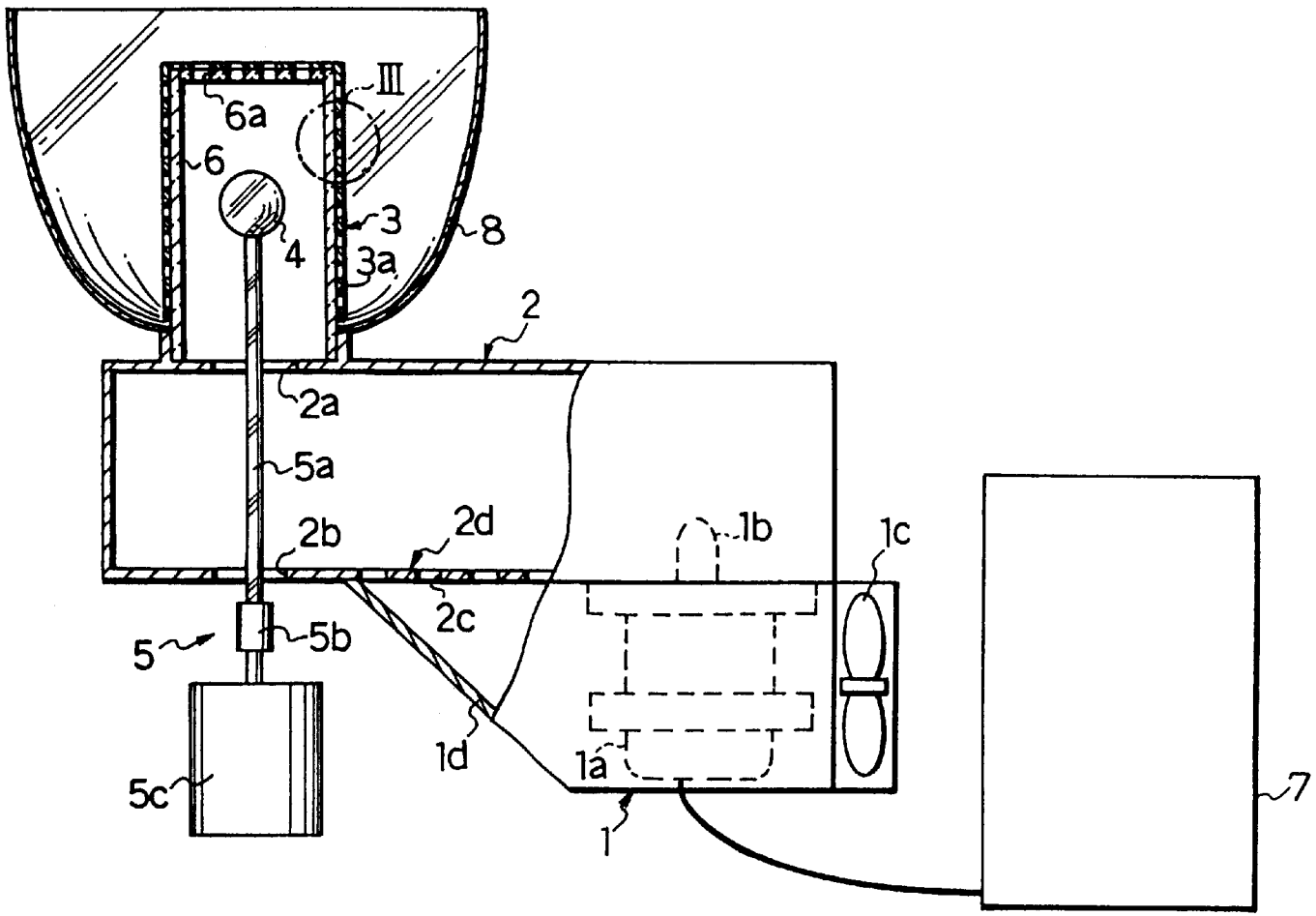
FIG. 2 is a schematic plan view showing a configuration of a microwave-excited discharge lamp apparatus in a second embodiment of the present invention.
Figure 3:
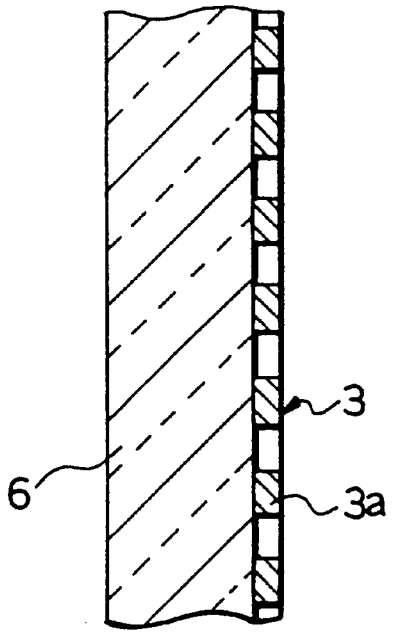
FIG. 3 is an enlarged sectional view of a blow guide and a metal member constituting a cavity resonator unit surrounded by a one-dot chain line III in FIG. 2.

As shown in FIGS. 2 and 3, a microwave-excited discharge lamp apparatus of this embodiment comprises a metal mesh member constituting the cavity resonator unit 3 on the outer surface of the blow guide 6. The other elements and portions are similar to those of the first embodiment, and therefore overlapping descriptions on the similar points are omitted.

In FIGS. 2 and 3, the metal mesh member 3*a* constituting the cavity resonator unit 3 is arranged on the outer surface of the blow guide 6. This metal mesh member 3*a* is formed, for example, by plating a metal on the blow guide 6 and etching it. With this configuration, the microwave-excited discharge lamp apparatus of this embodiment can have an improved mechanical strength of the cavity resonator unit 3 and the metal mesh member 3*a*. Furthermore, since the cavity resonator unit 3 and the blow guide 6 are constructed integrally with each other, the fabrication of the lamp apparatus is facilitated.

Figure 4:
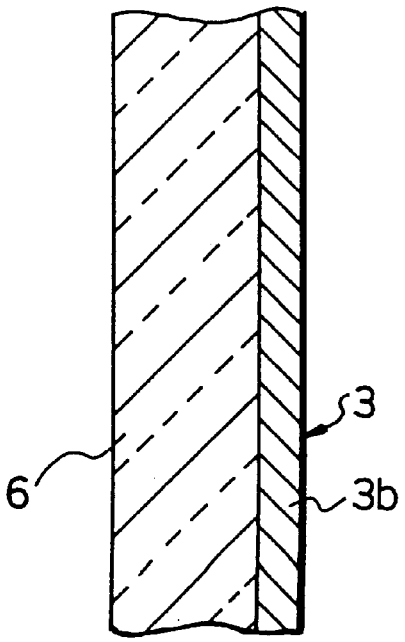
FIG. 4 is an enlarged sectional view of a blow guide and a transparent conductive film constituting another cavity resonator unit surrounded by the one-dot chain line III in FIG. 2.

Alternatively, as shown in FIG. 4, a conductive film 3*b* such as ITO (indium tin oxide) can be formed on the surface of the blow guide 6 instead of the metal mesh member 3*a*.

As another alternative, a meshed groove can be formed in the surface of the blow guide 6, so that the metal mesh member 3*a* can be fitted in the groove fixedly on the surface of the blow guide 6.

<<Third Embodiment>>

Figure 5:
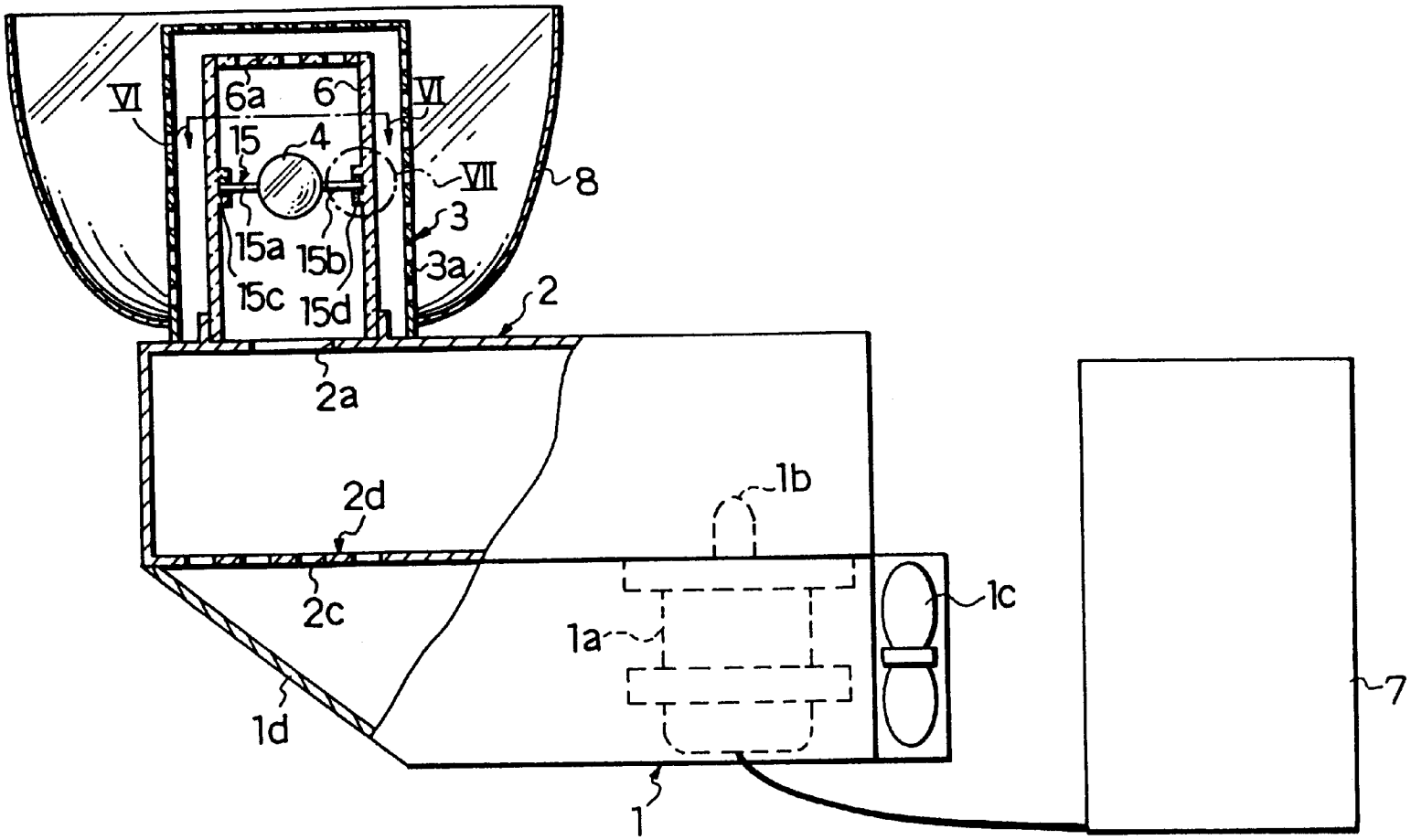
FIG. 5 is a schematic plan view showing a configuration of a microwave-excited discharge lamp apparatus in a third embodiment of the present invention.
Figure 6:
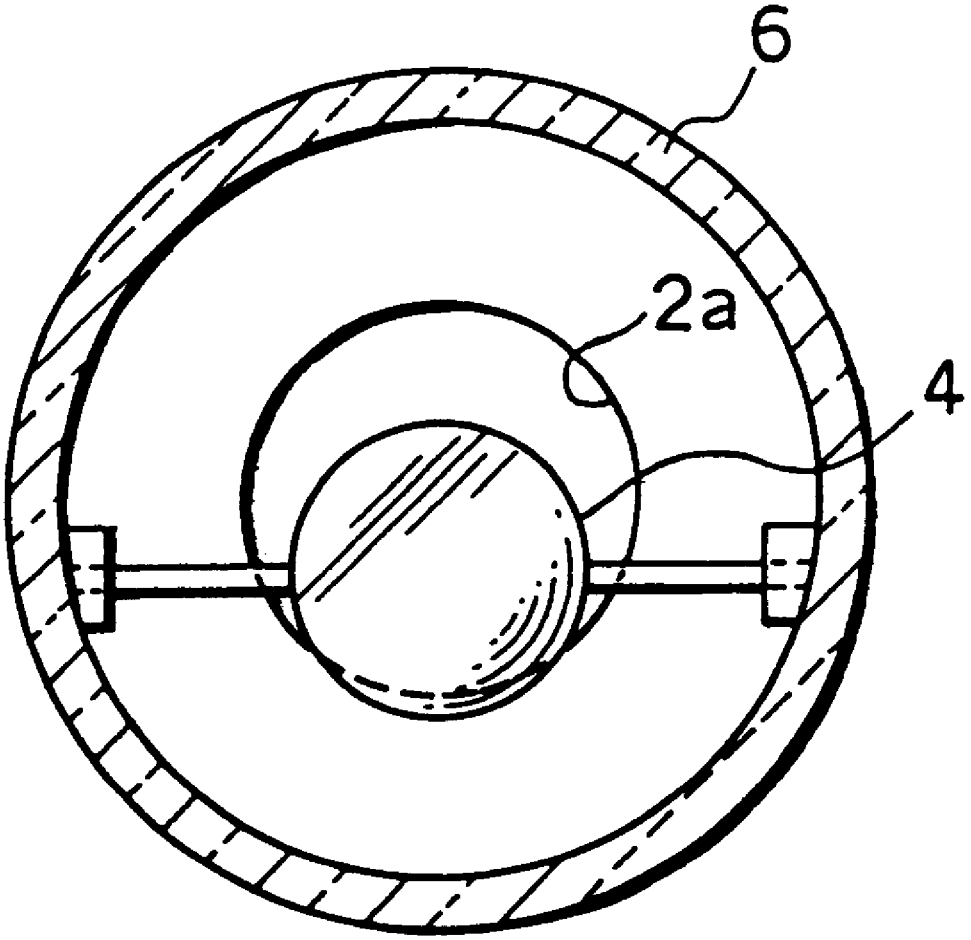
FIG. 6 is a sectional view showing relative positions of the lamp, the power feeding window and the blow guide taken on line VI—VI in FIG. 5.
Figure 7:
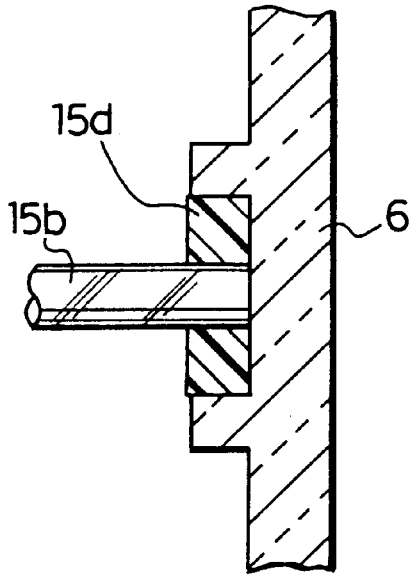
FIG. 7 is an enlarged sectional view of a configuration of a rod holder arranged on the inner surface of the blow guide surrounded by a one-dot chain line VII in FIG. 5.

As shown in FIGS. 5 through 7, the microwave-excited discharge lamp apparatus of this embodiment comprises a rotary supporter 15 for rotatably supporting the lamp 4 in the blow guide 6. The other elements and portions are similar to those of the first embodiment, and therefore overlapping descriptions on the similar points are omitted.

In FIGS. 5 through 7, the rotary supporter 15 includes a pair of supporting rods 15*a*, 15*b* connected to the lamp 4 symmetrically about the lamp 4, and rod holders 15*c*, 15*d* arranged on the inner surface of the blow guide 6 for rotatably supporting the supporting rods 15*a*, 15*b*, respectively. The rotary supporter 15 supports the lamp 4 in such a manner as to rotate the lamp 4 and the pair of the supporting rods 15*a*, 15*b* by the cooling air blown to the lamp 4 from the power feeding window 2*a*. Specifically, as shown in FIG. 6, the center of the spherical lamp 4 is shifted from the center of the power feeding window 2*a* and the center axis of the blow guide 6. The pair of the supporting rods 15*a*, 15*b* and the rod holders 15*c*, 15*d* are formed of a material not heated by the microwave electromagnetic field, such as quartz glass or a ceramic material like alumina ceramic. The supporting rods 15*a*, 15*b* are fixed on the lamp 4 by bonding glass or the like means. The lamp 4 and the pair of the supporting rods 15*a*, 15*b* can alternatively be formed integrally with each other.

Figure 8:
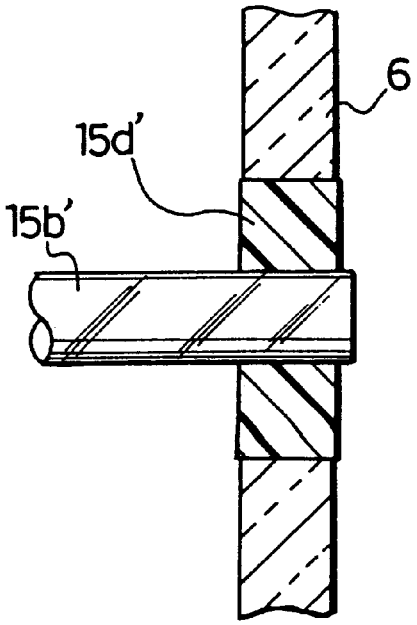
FIG. 8 is an enlarged sectional view of a configuration of another rod holder embedded in the inner surface of the blow guide surrounded by the one-dot chain line VII in FIG. 5.

With this configuration, one side of the lamp 4 is exposed to an air volume larger than the other side thereof. As a result, the lamp 4 is rotated by the cooling air with the pair of the supporting rods 15*a*, 15*b* as a rotational axis. As a result, the motor 5*c* or the like included in the first and second embodiments described above can be eliminated, thereby simplifying the configuration of the lamp apparatus. Furthermore, at least a blade can be mounted on the lamp 4 or the pair of the supporting rods 15*a*, 15*b* to increase the turning effort by the cooling air thereby to facilitate the rotation of the lamp 4. Further, instead of the pair of the supporting rods 15*a*, 15*b*, a single supporting rod and a rod holder thereof may be used for supporting the lamp 4 rotatably. In addition, as shown in FIG. 8, a rod holder 15*d*' can be embedded in the blow guide 6.

<<Fourth Embodiment>>

Figure 9:
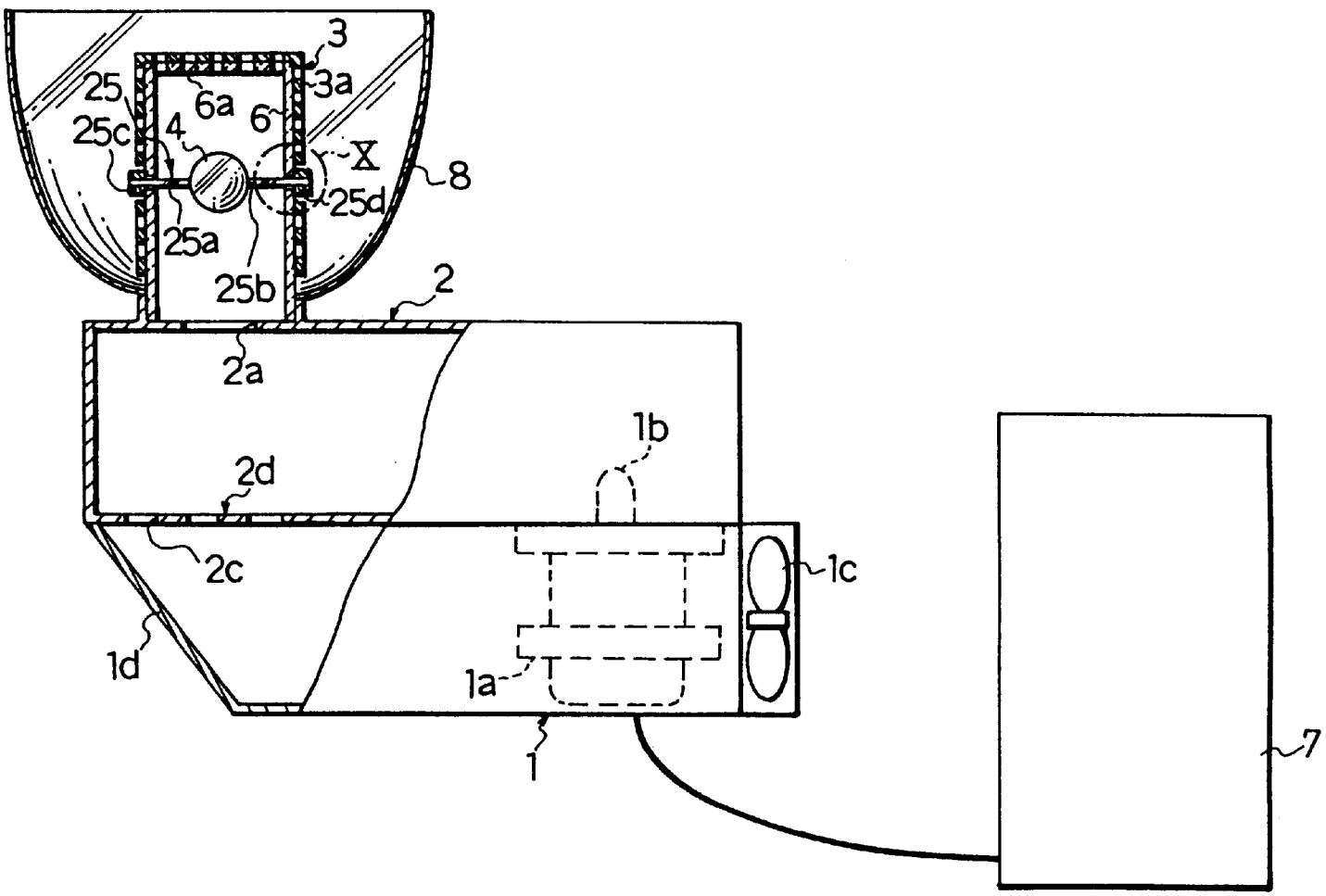
FIG. 9 is a schematic plan view showing a configuration of a microwave-excited discharge lamp apparatus in a fourth embodiment of the present invention.
Figure 10:
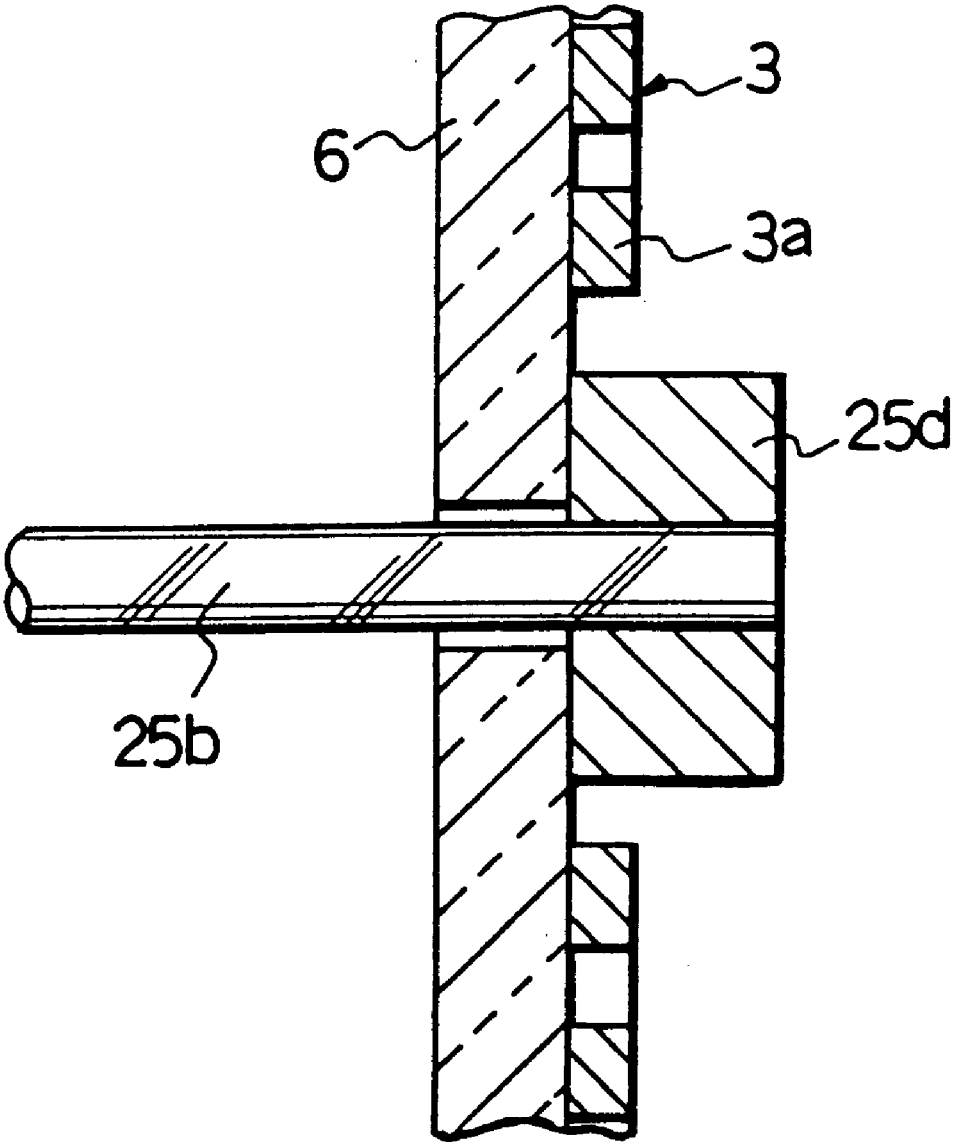
FIG. 10 is an enlarged sectional view of a configuration of a rod holder arranged on the outer surface of the blow guide surrounded by a one-dot chain line X in FIG. 9.
Figure 11:
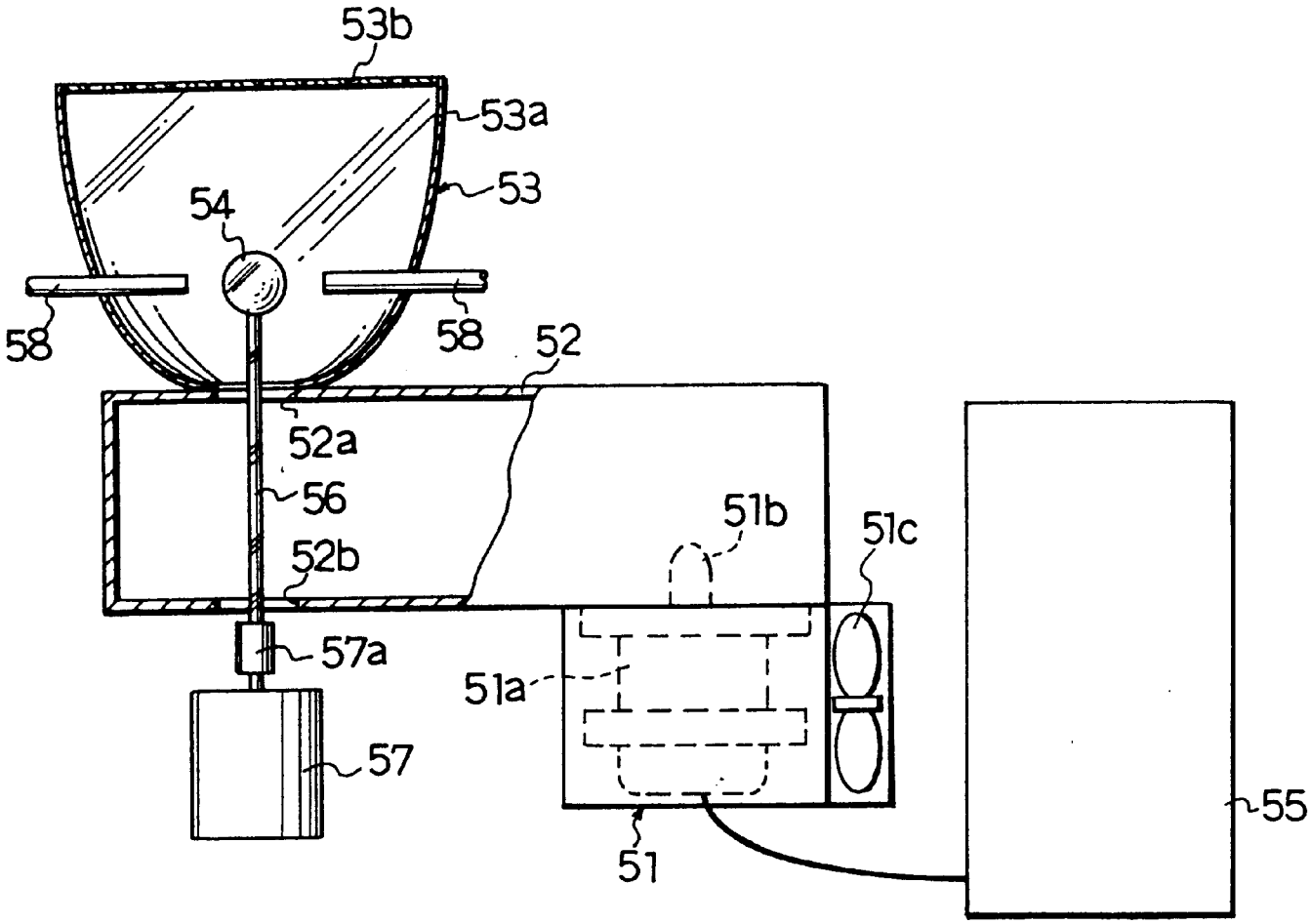
FIG. 11 (Prior Art)
FIG. 11 is a schematic plan view showing a configuration of a conventional microwave-excited discharge lamp apparatus.

As shown in FIGS. 9 and 10, in a microwave-excited discharge lamp apparatus of this embodiment, a metal mesh member constituting the cavity resonator unit 3 and metal rod holders 25*c*, 25*d* for supporting the lamp 4 rotatably are arranged on the outer surface of the blow guide 6. The other elements and portions are similar to those of the first embodiment, and therefore overlapping descriptions on the similar points are omitted.

In FIGS. 9 and 10, the metal mesh member 3*a* constituting the cavity resonator unit 3 is arranged on the outer surface of the blow guide 6. The rotary supporter 25 supports the lamp 4 rotatably in such a manner that the lamp 4 is rotated by the cooling air blown from the power feeding window 2*a*. Specifically, like the apparatus shown in FIG. 6, the lamp 4 is supported with the power feeding window 2*a* and the lamp 4 shifted from each other along the center axis of the blow guide 6. Further, the rotary supporter 25 includes a pair of supporting rods 25*a*, 25*b* connected to the lamp 4 symmetrically about the lamp 4, and rod holders 25*c*, 25*d* arranged on the outer surface of the blow guide 6 for rotatably supporting the supporting rods 25*a*, 25*b*, respectively. The pair of the supporting rods 25*a*, 25*b* are formed of the material not heated by the microwave electromagnetic field such as the quartz glass or the ceramic material including alumina ceramic. The rod holders 25*c*, 25*d* are formed of such a metal as stainless steel. With this configuration, in addition to the effects obtained in the third embodiment described above, a wider selection of materials of the rod holder is available and the cost is reduced without limiting the rod holder material.

In the above-mentioned third and fourth embodiments, the lamp 4 and the pair of the supporting rods 15*a*, 15*b* or 25*a*, 25*b* are both rotated by the cooling air. As an alternative to this configuration, a depression portion may can be formed in the surface of the lamp 4, for example, so that the lamp 4 is supported by the supporting rods fitted in the depression portion but not directly fixed on the lamp 4, and the lamp 4 alone is rotated by the cooling air.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

We claim:

1. A microwave-excited discharge lamp apparatus comprising:

a microwave generator, a waveguide for propagating a microwave generated from said microwave generator, a cavity resonator unit connected to said waveguide and for forming a predetermined microwave electromagnetic field, a lamp arranged in said cavity resonator unit and sealed with a luminous material, a rotary supporter for supporting said lamp rotatably, and a translucent blow guide arranged around said lamp and for conducting a gas to said lamp for cooling said lamp.

2. A microwave-excited discharge lamp apparatus in accordance with claim 1, wherein said blow guide is formed of selected one of translucent quartz glass and a translucent ceramic material.

3. A microwave-excited discharge lamp apparatus in accordance with claim 1, wherein said cavity resonator unit is formed of selected one of a metal mesh member arranged on the outer surface of said blow guide and a transparent conductive film.

4. A microwave-excited discharge lamp apparatus in accordance with claim 1, wherein said lamp is rotatably supported in such a manner as to be rotated by the cooling air flowing in said blow guide.

* * * * *